United States Patent [19]

Perego

[11] 4,391,367

[45] Jul. 5, 1983

[54] PACKING CONTAINER

[76] Inventor: Lucio C. Perego, 4835 Campbell Ct., Fort Wayne, Ind. 46804

[21] Appl. No.: 258,876

[22] Filed: Apr. 29, 1981

[51] Int. Cl.[3] ..... B65D 5/50; B65D 85/00

[52] U.S. Cl. ..... 206/315 R; 206/45.14; 206/45.19; 206/335; 220/307

[58] Field of Search ..... 206/315, 335, 45.19, 206/45.14; 220/4 E, 307, 8

[56] References Cited

U.S. PATENT DOCUMENTS

| | | | |
|---|---|---|---|
| 2,151,503 | 3/1939 | Dowst | 206/45.19 |
| 2,695,723 | 11/1954 | Waterman | 220/4 E |
| 2,880,262 | 3/1959 | Bell et al. | 220/307 |
| 3,847,275 | 11/1974 | Morrison et al. | 220/8 |
| 4,185,739 | 1/1980 | Wilford | 206/335 |

FOREIGN PATENT DOCUMENTS

| | | | |
|---|---|---|---|
| 465739 | 5/1937 | United Kingdom | 206/315 |

*Primary Examiner*—William T. Dixson, Jr.
*Attorney, Agent, or Firm*—George A. Gust

[57] ABSTRACT

A packing carton is provided with an auxiliary packing receptacle that is accessible without breaking open the sealed flaps of the packing carton. The method of use includes packing a first article, such as an electrical toy of the battery-powered type into the carton, closing and sealing the flaps of the carton, opening an auxiliary access flap, inserting a second article such as a battery into the auxiliary packing receptacle, and closing and sealing the auxiliary access flap.

23 Claims, 14 Drawing Figures

PACKING CONTAINER

BACKGROUND OF THE INVENTION

1. Field of the Invention

The present invention relates generally to packing containers and to a method for packaging, and more particularly to a carton device for packaging an electrical device, such as a toy, of the battery-powered type and for subsequently inserting a battery into the carton without breaking open the sealed flaps thereof.

2. Description of the Prior Art

The prior art includes corrugated cardboard packing cartons such as are commonly die cut and creased to provide a plurality of wall and flap portions which are subsequently folded to provide a rectangular packing carton with an open top or end that is closable by folding, overlapping, and sealing the flap portions.

The present invention provides an important improvement over the prior art in that it provides an auxiliary packing receptacle which is accessible without breaking open the sealed flap portions of the packing carton.

The present invention is particularly useful for shipping electrical devices of the battery-powered type because of the perishable nature of batteries. The electrical device is packaged at time of manufacture; and a battery can be inserted into the packing carton by the manufacturer or distributor prior to shipment or by the dealer at the time of sale without breaking open the packing carton.

SUMMARY OF THE INVENTION

In accordance with the broader aspects of this invention, there is provided a packing carton that includes a plurality of interconnecting and cooperating wall portions and a plurality of flap portions. When folded, the cooperating wall portions provide a first packing volume, and the flap portions provide access thereto.

An inner tray, having a bottom and sides, is sized for slidable insertion into the packing carton. A rectangular hole, that is much smaller than the bottom of the inner tray is cut therethrough.

A auxiliary receptacle, or battery basket, having a bottom and an open top provided with a lateral flange portion is inserted into the opening in the bottom of the tray with the basket portion extending thereinto and with the flange portion underneath the bottom. Thus, the receptacle provides an auxiliary packing volume that effectively separates the first packing volume of the main carton from the remainder.

An electrical device of the battery-powered type is packed into the inner tray, the inner tray is slidingly inserted into the packing carton, the flap portions of the carton are folded to closed position.

At any desired later date, an auxiliary access flap disposed in one of the wall portions of the carton, and which is located to substantially coincide with the open top of the receptacle, is opened; and a battery is slidingly inserted into the receptacle where it is retained by deflectable battery-retaining clips. Then the auxiliary access flap is closed and an adhesively coated patch may be used to seal the auxiliary access flap.

In another embodiment, the receptacle is mounted in suitable openings in the carton end flaps, the outermost flap having the access flap therein.

It is an object to provide a package and method of packaging which combines an auxiliary package with a main package, the auxiliary package being accessible without opening the previously closed main package.

The above-mentioned and other features and objects of this invention and the manner of attaining them will become more apparent and the invention itself will be best understood by reference to the following description of an embodiment of the invention taken in conjunction with the accompanying drawings.

DESCRIPTION OF THE PREFERRED EMBODIMENT

Figure 1:
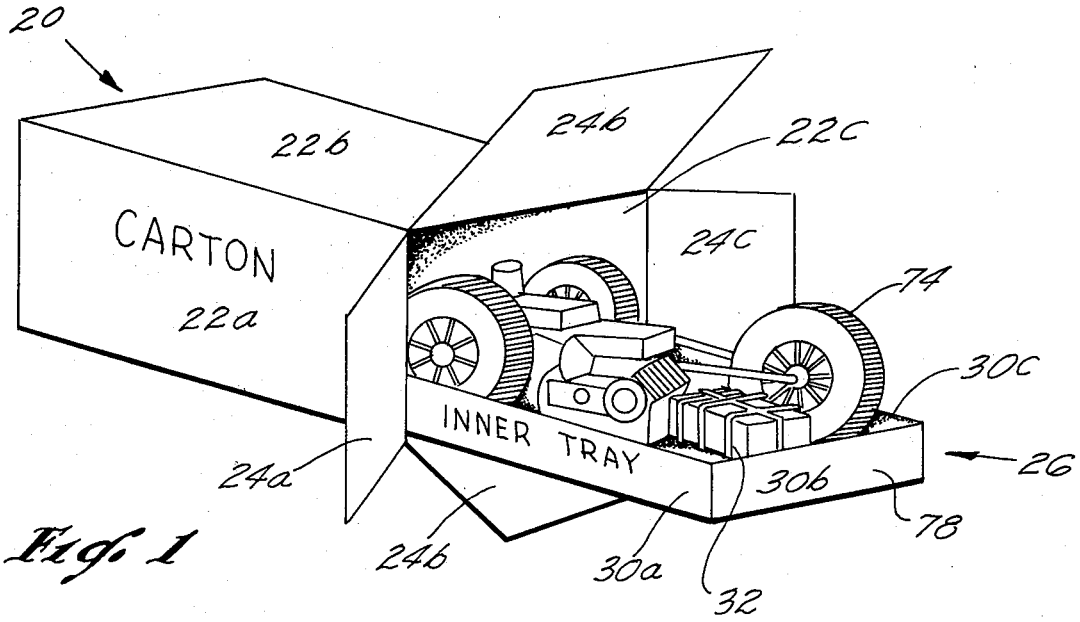
FIG. 1 is a perspective view of the packing carton with the flap portions open and the inner tray partially inserted into the packing carton.
Figure 2:
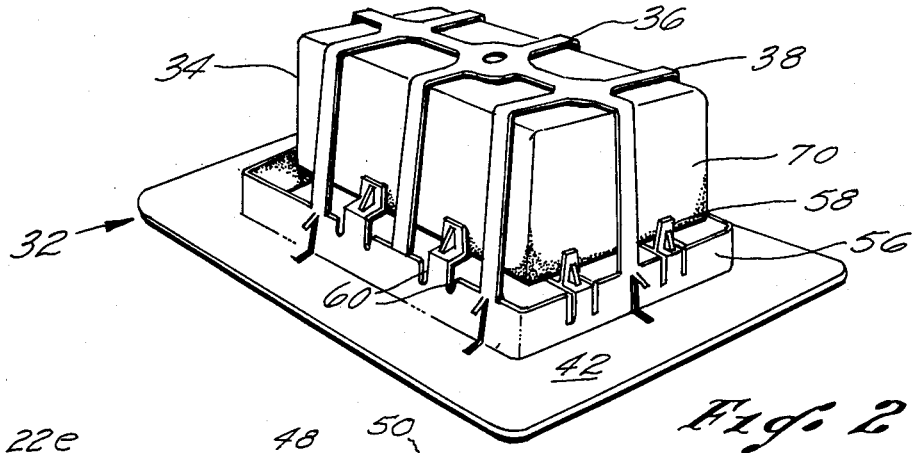
FIG. 2 is a perspective view of the battery basket, taken substantially as shown in FIG. 1, showing a battery inserted therein.
Figure 3:
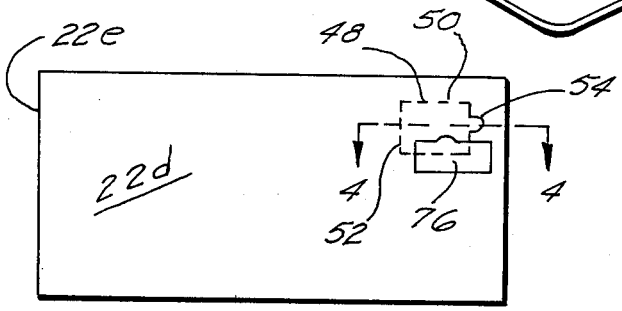
FIG. 3 is a bottom view of the packing carton, showing the auxiliary access flap and a portion of the adhesively coated patch.

Referring now to FIGS. 1 and 3, a packing carton 20 of corrugated cardboard or the like includes walls **22*a*–22*e*. The carton 20 also includes end flap portions 24*a*–24*d*. An inner tray 26 also of corrugated cardboard includes a bottom wall 28 (FIG. 4) and four upstanding side walls 30*a*–30*c***.

Referring now to FIGS. 1–2 and 4–7, a battery basket or receptacle 32 molded of a suitable resilient plastic material includes a basket-like portion 34 which comprises a plurality of interconnecting straps 36 that form a bottom 38, and an open top 40. It also includes a laterally outwardly extending flange 42 that is attached to and surrounds the open top 40.

Figure 4:
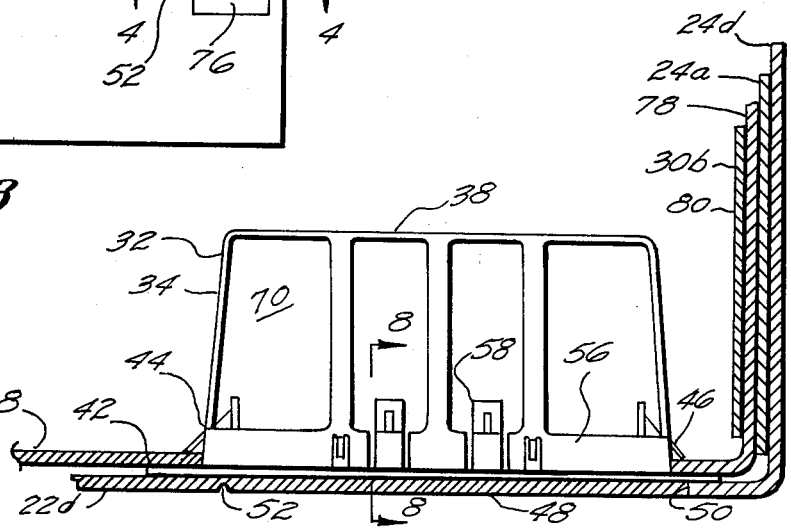
FIG. 4 is a partial and enlarged cross-section of the packing carton and inner tray of FIG. 1, taken substantially as shown by section line 4—4 of FIG. 3.
Figure 5:
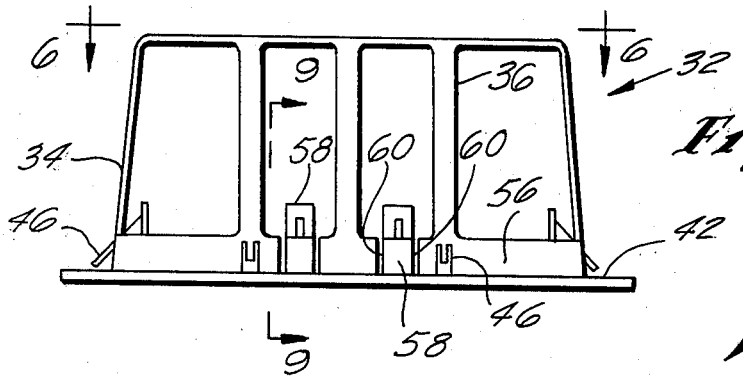
FIG. 5 is a side view of the battery basket of FIG. 2, taken substantially as shown in FIG. 4.
Figure 6:
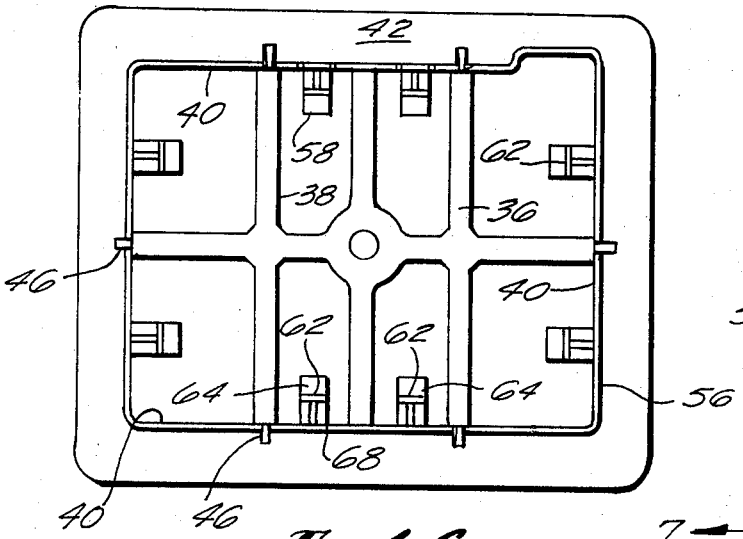
FIG. 6 is a plan view of the battery basket of FIG. 5, taken substantially as shown by view line 6—6 of FIG. 5.
Figure 7:
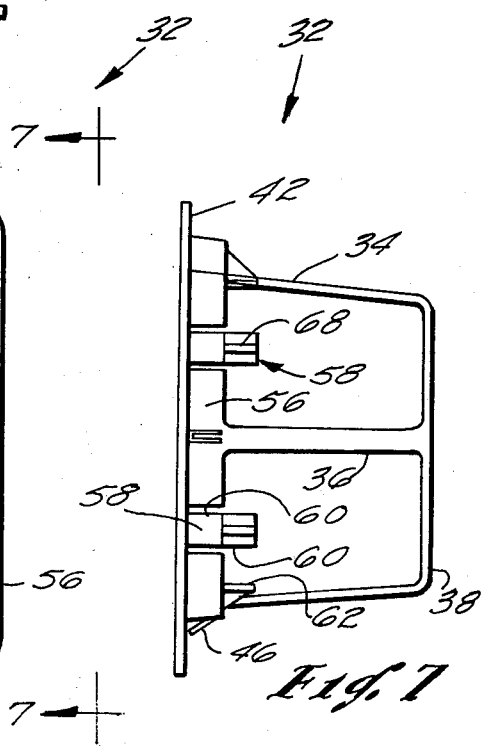
FIG. 7 is an end view of the battery basket of FIG. 6, taken substantially as shown by view line 7—7 of FIG. 6.

Referring to FIGS. 4–7, and more particularly to FIG. 4, the bottom wall 28 of the tray 26 includes an opening 44. The basketlike portion 34 of the battery basket 32 is inserted through the opening 44 with the portion 34 extending upwardly and inwardly into the tray 26 as shown and with the flange portion 42 close to the bottom 28 by means of a plurality of deflectable retaining clips 46.

Referring to FIGS. 3 and 4, an auxiliary access flap 48 is provided in the wall 22*d* of the carton 20 in registry with the open top 40 of receptacle 32 when the tray is fully inserted into carton 30. The auxiliary access flap 48 is preferably defined by perforations or scoring lines 50, which substantially define three edges thereof.

A crease 52 defines a fourth edge and hinge of the access flap 48. Preferably, a lift tab 54 is provided to facilitate lifting or opening flap 48.

Referring to FIGS. 4–10, the receptacle 32 includes a depending flange 56 integral with the flange 42 which forms a peripheral rim at the top of the portion 34. Preferably, the opening 44 in the bottom 28*d* is sized and shaped to fit closely around the flange 56.

A plurality of deflectable, resilient retaining clips 58 are molded integrally with the flange 56, and each of the clips 58 is given extra resilience by slots 60 that separate the clips 58 from adjoining portions of the flange 56.

Figure 8:
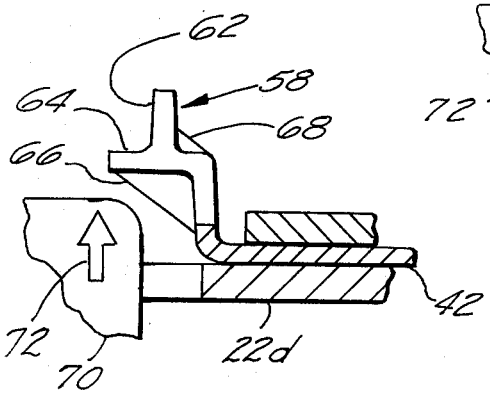
FIG. 8 is a partial and enlarged cross-section, taken substantially as shown by section line 8—8 of FIG. 4, showing an enlarged detail of the deflectable battery-retaining clips.
Figure 9:
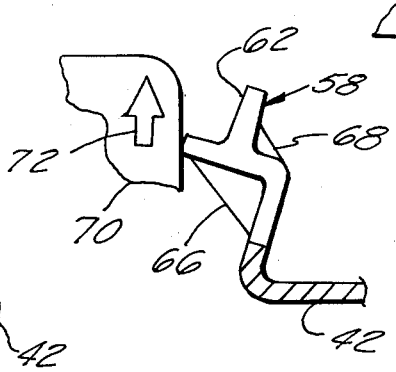
FIG. 9 is a partial and enlarged cross-section, taken substantially as shown by section line 9—9 of FIG. 5, showing the deflectable battery-retaining clip of FIG. 8 being deflected as the battery is being inserted into the battery basket of FIG. 2.
Figure 10:
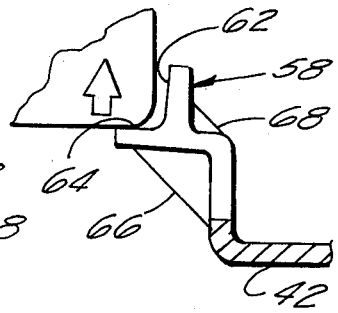
FIG. 10 is a partial and enlarged cross-section showing the battery-retaining clip of FIG. 9 with the battery being retained in the battery basket as shown in FIG. 2.
Figure 11:
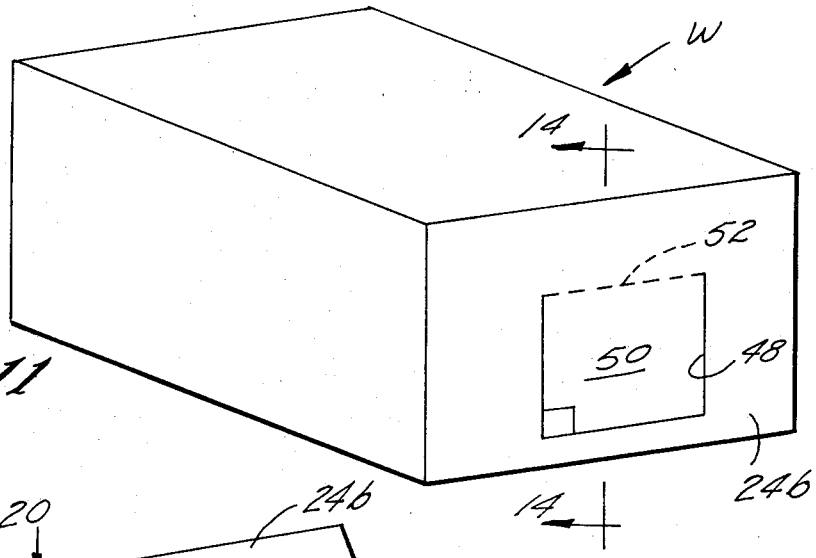
FIG. 11 is a perspective view of a second embodiment.
Figure 12:
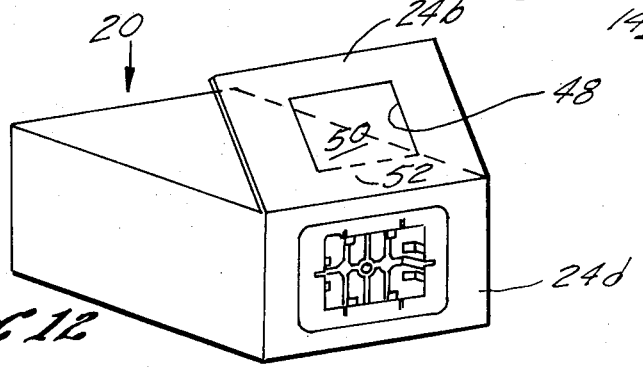
FIG. 12 is a similar view with one end flap opened to expose the receptacle mounted in the other flap.
Figure 13:
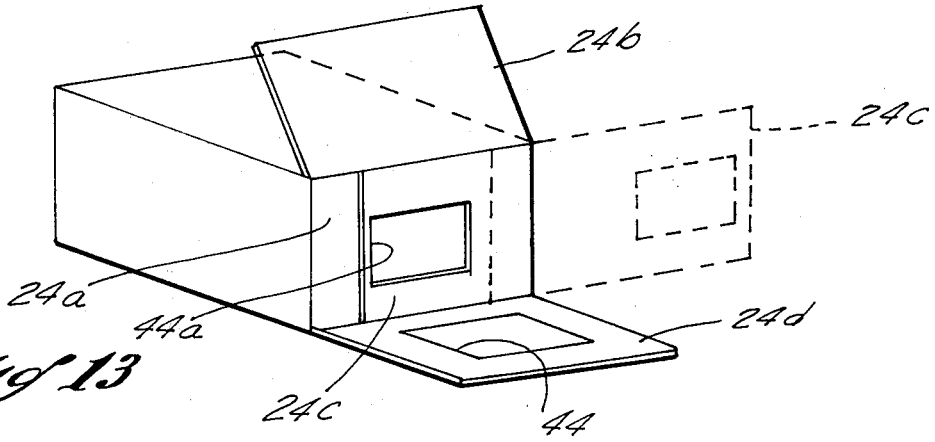
FIG. 13 is like FIG. 12 but with an additional flap opened.
Figure 14:
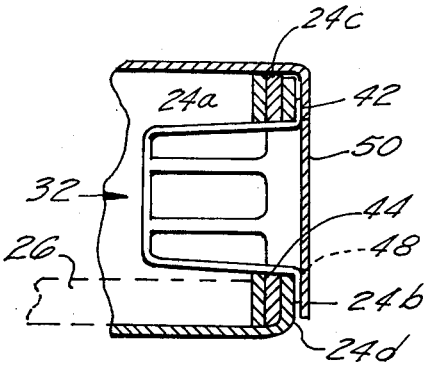
FIG. 14 is a section taken substantially along section line 14—14 of FIG. 11.

Referring to FIGS. 8–10, the retaining clips 48 each include a shoulder 62, a shoulder 64, and gussets 66 and 68. The gussets 66 and 68 add strength and, in addition each acts as a camming surface which may be engaged by a battery 70 as it is being inserted into the receptacle 32 for deflecting clips 58 outwardly in the direction of arrow 72 as shown in FIG. 9.

The resilient clips 46 are integral with the flange 56 and extend outwardly therefrom as clearly shown in FIGS. 2 and 4–7.

Referring now to FIGS. 1–4 and 8–10, the method of packaging includes inserting the portion 34 of the receptacle 32 through the opening 44 of the bottom 28 of the tray 26, locking the receptacle 32 in the opening 44 with the flange 42 close to the bottom 28 by means of the deflectable retaining clips 46, packing an electrical device such as a toy 74 of the battery-powered type in the tray 26, sliding the tray 26 into the packing carton 20 so that the wall portion 22*d* of the carton 20 overlaps the bottom 28 of the tray 26 and so that the flange 42 of the receptacle 32 is secured between the wall portions 22*d* and 28, and closing and sealing the flap portions 24.

The method further includes opening the auxiliary access flap 48, inserting a battery 70 into the receptacle 32 deflecting outwardly the clips 58 as shown in FIG. 9, securing the battery 70 in the receptacle 32 by reason of the clips springing back into engagement therewith, closing the access flap 48, and placing an adhesively coated patch 76 over the flap 48 to hole it closed.

Referring to FIGS. 1 and 4, the side 30*b* of tray 30*b* of tray 26 includes an outer wall 78 integral with the bottom 28 that overlaps an inner wall integral with the side wall 30*a*. Thus, the construction of the inner tray 26 is conventional.

The flap portions 24*a* and 24*c* fold inwardly to form an inner wall portion of the packing carton 20, and the flap portions 24*b* and 24*d* fold inwardly to form an overlapping outer wall portion of the packing carton 20. This also is conventional construction for a packing carton.

A second embodiment of the invention is shown in FIGS. 11 through 14. Like numerals will indicate like parts. As in the first embodiment, an inner tray 26 is so sized that when the flaps 24 are closed, they abut against the end of the tray thereby preventing further inward movement of the flaps.

In this embodiment, the receptacle 32 is installed in the overlapped and superposed end flaps 24 which provide for more wall strength than is true of the first embodiment. When folded over to close the end of the carton, the outermost flap 24*b* has the access flap 48 therein. The next adjacent flap 24*d* has the opening 44 which receives the receptacle 32, the flange 42 being clamped between the two flaps 24*b* and 24*d*. The inner overlapping flaps 24*a* and 24*c* also have rectangular openings 44*a* therein for receiving the receptacle 32 therethrough, the size of all these openings being only slightly larger than the outer dimensions of the receptacle 32 such that the receptacle slidably fits into the openings. The tabs 46 may be sized to engage only the flap 24*d* or, alternatively, may grip all four flaps 24 when the receptacle 32 is installed.

In use, articles, such as a disassembled toy as shown in FIG. 1 is inserted into the tray 26 which is then slid into the carton. The flaps 24 are then closed to seal the carton. The access door 50 is then opened around the fold line 52 and the receptacle 32 is then inserted through the openings in the three flaps 24*a*, 24*c* and 24*d*. Since the receptacle 32 has a sliding fit with these openings, there is some tendancy for the flaps to be moved inwardly therewith. By reason of the position of the tray 26 within the carton, the flaps engage against one edge thereof which is sufficient to hold the flaps against inward movement thereby facilitating installation of the receptacle 32. With the receptacle 32 fully installed, the tabs 46 which were deflected during installation spring outwardly to engage the back side of the respective flaps thereby securely mounting the receptacle in place. The access door 50 is then closed and adhesively secured.

In summary, the present invention provides a packing carton having main and auxiliary packing volumes, and means for defining an auxiliary access into the auxiliary packing volume without opening the main packing volume.

While there have been described above the principles of this invention in connection with specific apparatus, it is to be clearly understood that this description is made only by way of example and not as a limitation to the scope of the invention.

What is claimed is:

1. A packing device comprising a packing container having one or more wall portions, an auxiliary packing receptacle within the volume of said packing container mounted adjacent to one of said wall portions and having a first access opening registrable with a second access opening in said one wall portion, said receptacle includes means for retaining one or more articles therein, said one wall portion having a manipulable closure for the second opening therein, said one wall portion including a first sheet-like element, a second sheet-like element overlying said first element and having a third opening therein, said receptacle being received by and carried within said third opening and having a laterally extending flange-like portion interposed between said elements.

2. The device of claim 1, wherein said receptacle has a flange surrounding said first opening which is interposed between said elements.

3. The device of claim 1 wherein said receptacle includes means for locking said flange-like portion to said second sheet element.

4. The device of claim 3 wherein said locking means includes locking tabs spaced from said flange-like portion such that the thickness of said second sheet element is engageably interposed therebetween.

5. A packing device comprising a packing container having one or more wall portions, an auxiliary packing receptacle within the volume of said packing container mounted adjacent to one of said wall portions and having a first access opening registrable with a second access opening in said one wall portion, said receptacle includes means for retaining one or more articles therein, said one wall portion having a manipulable closure for the second opening therein, wherein said container includes a rectangular cardboard carton having end closure flaps, said one wall portion being one of the walls of said carton, an open tray having a flat bottom and being slidably received by said carton, said bottom overlying said one wall and having a third opening in registry with said second access opening, and said receptacle being received by said third opening with the first access opening being in registry therewith.

6. The device of claim 5 including means for locking said receptacle to said tray bottom.

7. The device of claim 6 wherein said locking means includes a laterally outwardly extending flange surrounding said first opening and tabs spaced from said flange, the thickness of said bottom being engageably received within such space with said flange overlying the adjacent surface of said bottom.

8. The device of claim 7 wherein said tabs are resilient and may be fixed inwardly toward the receptacle and away from the edges of said third opening, whereby said receptacle may be slidably inserted into said third opening deflecting said tabs inwardly until said flange engages said adjacent bottom surface, said tabs then springing outwardly into locking position as aforesaid.

9. The device of claim 6 wherein said receptacle includes resiliently deflectable article-retaining clips which normally extend inwardly of the space within said receptacle, said clips being deflectable outwardly relative to said space whereby an article inserted into said receptacle will deflect said tabs outwardly until therepast following which said tabs will spring inwardly into overlying relation to said article.

10. A packing device comprising a packing container having one or more wall portions, an auxiliary packing receptacle within the volume of said packing container mounted adjacent to one of said wall portions and having a first access opening registrable with a second access opening in said one wall portion, said receptacle includes means for retaining one or more articles therein, said one wall portion having a manipulable closure for the second opening therein, said container including a rectangular cardboard carton having end closure flaps, said one wall portion being one of the flaps of said carton, another of said flaps being movable into juxtaposed relation with said one flap and having a third opening in registry with said second opening, and said receptacle being received by said third opening with the first opening being in registry therewith.

11. The device of claim 10 including means for locking said receptacle to said other flap.

12. The device of claim 11 wherein said locking means includes a laterally outwardly extending flange surrounding said first opening and tabs spaced from said flange, the thickness of said other flap being engageably received within such space with said flange overlying the adjacent surface of said other flap.

13. The device of claim 12 wherein said tabs are resilient and may be flexed inwardly toward the receptacle and away from the edges of said third opening, whereby said receptacle may be slidably inserted into said third opening deflecting said tabs inwardly until said flange engages said adjacent bottom surface, said tabs then springing outwardly into locking position as aforesaid.

14. The device of claim 13 wherein said receptacle includes resiliently deflectable article-retaining clips which normally extend inwardly of the space within said receptacle, said clips being deflectable outwardly relative to said space whereby an article inserted into said receptacle will deflect said tabs outwardly until therepast following which said tabs will spring inwardly into overlying relation to said article.

15. The device of claim 14 wherein the two flaps are hingedly connected to two walls, respectively, of said carton and movable into juxtaposed overlying relation, third and fourth closure flaps also hingedly connected to two other walls, respectively, of said carton and movable into overlying relation relative to the first two flaps, said third and fourth flap having openings which receive said receptacle therethrough.

16. The device of claim 15 including a tray slidably received by said cartons, said tray being of a size that when said flaps are closed they will abut said tray and thereby be held against movement.

17. An auxiliary receptacle for use in conjunction with a packing carton having a wall portion, comprising:

a container having sides, an open top and a bottom, a flange secured to said container adjacent said open top to extend laterally outwardly from the opening therein, tabs on said container extending outwardly therefrom and being closely spaced from said flange by a distance approximately the thickness of said wall portion, and said tabs being resiliently deflectable, a plurality of article-retaining clips on said container extending inwardly thereof adjacent to said open top, said clips being resiliently deflectable outwardly.

18. The receptacle of claim 17 wherein said container, tabs and clips are integrally formed of plastic material, said clips being elongated and hingedly connected to the edge portions of the opening in said top, ramp portions on the outer sides of said clips which incline inwardly toward the central portion of said container, and downwardly toward said bottom, said clips further having ledge portions which extend substantially parallel to the respective sides and toward said bottom, said tabs being elongated and hingedly connected to said container sides to extend outwardly therefrom, said tabs being inclined outwardly from said sides and toward said flange, said sides and bottom being an open gridwork of integrally connected strap-like elements.

19. The device of claim 18 including in combination a carton device having on one wall two superposed sheet-like elements, said elements having two openings therein which are in registry, said container being received by one of said openings to extend into said carton and with said flange interposed between said elements, said element with said one opening having its thickness engageably fitted into the space between said flange and tabs thereby locking said container in place, and a closure flap on the other sheet-like element which is manipulable to open and close said other of said two openings.

20. A packing device comprising a packing container having one or more wall portions, and an auxiliary packing receptacle within the volume of said packing container mounted adjacent to one of said wall portions and having a first access opening registrable with a second access opening in said one wall portion, said receptacle including means for retaining one or more articles therein, and said one wall portion having a manipulable closure for the second opening therein, said one wall portion including a first sheet-like element, a second sheet-like element overlying said first element and having a third opening therein, said receptacle being received by and carried within said third opening.

21. A packing device comprising a packing container having a wall portion, an auxiliary packing receptacle within said container having a first access opening registrable with a second access opening in said wall portion, a second wall portion having a third opening therein, said third opening receiving said receptacle with said first opening being in registry therewith, and said first and second wall portion being relatively movable for moving said first opening of said receptacle relative to said second opening thereby to move them into registration.

22. The packing device of claim 21 wherein said first and second wall portions are parallel and relatively movable in substantially parallel planes.

23. The packing device of claim 21 wherein said first and second wall portions are relatively swingable for moving said first and second openings into and out of registration, respectively.

* * * * *

UNITED STATES PATENT AND TRADEMARK OFFICE

CERTIFICATE OF CORRECTION

PATENT NO. : 4,391,367

DATED : July 5, 1983

INVENTOR(S) : Lucio C. Perego

It is certified that error appears in the above—identified patent and that said Letters Patent is hereby corrected as shown below:

Column 5, Line 37, change "fixed" to --flexed--.

Signed and Sealed this

*Twentieth* Day of *December 1983*

[SEAL]

*Attest:*

GERALD J. MOSSINGHOFF

*Attesting Officer*

*Commissioner of Patents and Trademarks*